US005466334A

United States Patent [19]

Fredriksson et al.

[11] Patent Number: 5,466,334

[45] Date of Patent: Nov. 14, 1995

[54] METHOD AND APPARATUS FOR MIXING A TREATMENT AGENT WITH A PULP SUSPENSION

[75] Inventors: Börje Fredriksson, Sundsvall; Kjell Forslund, Sundsbruk, both of Sweden

[73] Assignee: Sunds Defibrator Industries Aktiebolag, Sundsvall, Sweden

[21] Appl. No.: 199,239

[22] PCT Filed: Aug. 19, 1992

[86] PCT No.: PCT/SE92/00557

§ 371 Date: Feb. 28, 1994

§ 102(e) Date: Feb. 28, 1994

[87] PCT Pub. No.: WO93/04772

PCT Pub. Date: Mar. 18, 1993

[30] Foreign Application Priority Data

Sep. 5, 1991 [SE] Sweden ..... 9102551

[51] Int. Cl.[6] ..... D21B 1/34

[52] U.S. Cl. ..... 162/56; 162/18; 162/26; 162/261; 366/171.1; 366/172.1; 366/307

[58] Field of Search ..... 162/18, 26, 56, 162/261, 243; 366/168.1, 171.1, 172.1, 307

[56] References Cited

U.S. PATENT DOCUMENTS

| | | | |
|---|---|---|---|
| 4,339,206 | 7/1982 | Ahs | 366/307 |
| 4,416,548 | 11/1983 | Carre et al. | 366/168 |
| 4,577,974 | 3/1986 | Prough et al. | 366/279 |
| 4,834,547 | 5/1989 | Niskanen | 366/165 |
| 5,088,831 | 2/1992 | Reinhall | 366/171 |

FOREIGN PATENT DOCUMENTS

| | | |
|---|---|---|
| 1102604 | 5/1979 | Canada . |
| 461134 | 1/1990 | Sweden . |

*Primary Examiner*—David L. Lacey
*Assistant Examiner*—Dean T. Nguyen
*Attorney, Agent, or Firm*—Lerner, David, Littenberg, Krumholz & Mentlik

[57] ABSTRACT

Methods for mixing a treatment agent with a pulp suspension are disclosed including supplying the pulp suspension to a mixing chamber, moving the pulp suspension through a mixing zone with the mixing chamber, supplying the treatment agent to the moving pulp suspension across the entire width of the mixing chamber prior to the mixing zone, and in which the height of the mixing zone is sufficiently small such that the pulp suspension and the treatment agent are subjected to kneading within the mixing zone in order to repeatedly stretch and compress fiber flocks in the pulp suspension. Apparatus for mixing the treatment agent with the pulp suspension are also disclosed.

26 Claims, 3 Drawing Sheets

METHOD AND APPARATUS FOR MIXING A TREATMENT AGENT WITH A PULP SUSPENSION

FIELD OF THE INVENTION

The present invention relates to methods and apparatus for mixing a treatment agent with a pulp suspension. More particularly, the present invention relates to methods and apparatus for mixing such treatment agents which can be chemicals, such as bleaching chemicals, in a liquid or gaseous state.

BACKGROUND OF THE INVENTION

In connection with various types of chemical delignification, it is decisively important to obtain persistently uniform and proportional admixing of chemicals with the pulp in order to achieve acceptable results. With such uniform admixing it is then possible to obtain uniform results in terms of treatment, as well as optimum utilization of the chemicals to the smallest required extent, as well as the lowest required temperature and shortest required reaction time. In order to minimize the chemical demand, and to further reduce the energy demand, it is desirable to carry out this treatment at a relatively high pulp concentration, preferably from about 10 to 25%.

In connection with the known devices, however, such high pulp concentrations create problems of a uniform distribution of the chemicals in the pulp. Present such devices normally comprise rotary members, which intensively agitate the pulp while the chemicals are simultaneously added thereto. Presently available devices are also relatively large, and require a great deal of energy. A substantial portion of the energy supplied to these devices is transformed solely into heat, and is thus not utilized efficiently during the mixing operation itself.

SUMMARY OF THE INVENTION

In accordance with the present invention, these and other problems have now been overcome by the invention of a method for mixing a treatment agent with a pulp suspension comprising supplying the pulp suspension to a mixing chamber having a predetermined width, moving the pulp suspension through a mixing zone within the mixing chamber, the mixing zone having a predetermined height, and supplying the treatment agent to the moving pulp suspension across the entire predetermined width of the mixing chamber prior to the mixing zone, the predetermined height of the mixing zone being sufficiently small so that the pulp suspension and the treatment agent are subjected to kneading within the mixing zone in order to repeatedly stretch and compress fiber flocks in the pulp suspension. In a preferred embodiment, the pulp suspension has a concentration of between about 10 and 25%.

In accordance with one embodiment of the method of the present invention, the kneading in the mixing zone is carried out at an energy input of between about 0.5 and 5 kwh per ton of the pulp suspension. In another embodiment, the pulp suspension and the treatment agent pass through the mixing zone for a time period of about 1/100 to about 1/5 of a second.

In accordance with the present invention, apparatus has also been provided for mixing a treatment agent with a pulp suspension which comprises a housing having an inner wall and a predetermined width, a substantially cylindrical rotor rotatably mounted within the housing for rotation at a predetermined direction about an axis, the rotor having a predetermined axial length substantially corresponding to the predetermined width of the housing and having an outer surface including mixing members thereon, a mixing chamber defined by the space between the housing and the rotor, an inlet in the housing for providing the pulp suspension to the mixing chamber, an outlet in the housing for withdrawing the pulp suspension and treatment agent from the mixing chamber, a treatment agent inlet in the housing for providing the treatment agent to the mixing chamber, and stationary mixing means mounted on the inner wall of the housing for a predetermined distance therealong, thereby defining a mixing zone for the predetermined distance within the gap between the mixing means and the mixing members on the outer surface of the rotor.

In accordance with a preferred embodiment of the apparatus of the present invention, the treatment agent inlet is located before the mixing zone in the predetermined direction of rotation of the rotor.

In accordance with one embodiment of the apparatus of the present invention, the predetermined distance of the stationary mixing means is about 15° to 180° of the circumference of the inner wall surface of the housing.

In accordance with another embodiment of the apparatus of the present invention, the mixing members comprise a plurality of mixing members extending substantially axially along the outer surface of the rotor. In a preferred embodiment, the plurality of mixing members include a leading edge and a trailing edge in the predetermined direction of rotation of the rotor, the leading edge being substantially transverse to the outer surface of the rotor, and the trailing edge forming a gradually sloping surface with respect to the outer surface of the rotor.

In accordance with another embodiment of the apparatus of the present invention, the stationary mixing means has a substantially trapezoidal cross-sectional shape. In another embodiment, the gap between the outer surface of the rotor and the stationary mixing means is between about 2 and 20 mm.

In accordance with another embodiment of the apparatus of the present invention, the apparatus includes reverse flow prevention means mounted on the inner surface of the housing adjacent to the outlet in the predetermined direction of rotation of the rotor to prevent the reverse flow of the pulp suspension towards the outlet in a direction opposite to the predetermined direction of rotation of the rotor. In a preferred embodiment, the reverse flow prevention means comprises a cylindrical surface. In a highly preferred embodiment, the reverse flow prevention means extends along the inner surface of the housing for a distance corresponding to about 5° to 180° of the circumference of the mixing chamber. Preferably, the reverse flow prevention means is mounted with respect to the mixing members on the outer surface of the rotor at a distance of from about 1 to 4 mm therefrom.

In accordance with this invention, the above-noted problems in the prior art are significantly reduced by carrying out the work of mixing within a relatively small mixing volume and at high energy density. This can be achieved by carrying out the mixing in thin layers or gaps so that the energy being supplied is utilized at a higher optimum rate.

BRIEF DESCRIPTION OF THE DRAWINGS

The following detailed description can be more readily understood with reference to the drawings, in which.

DETAILED DESCRIPTION

Figure 1:
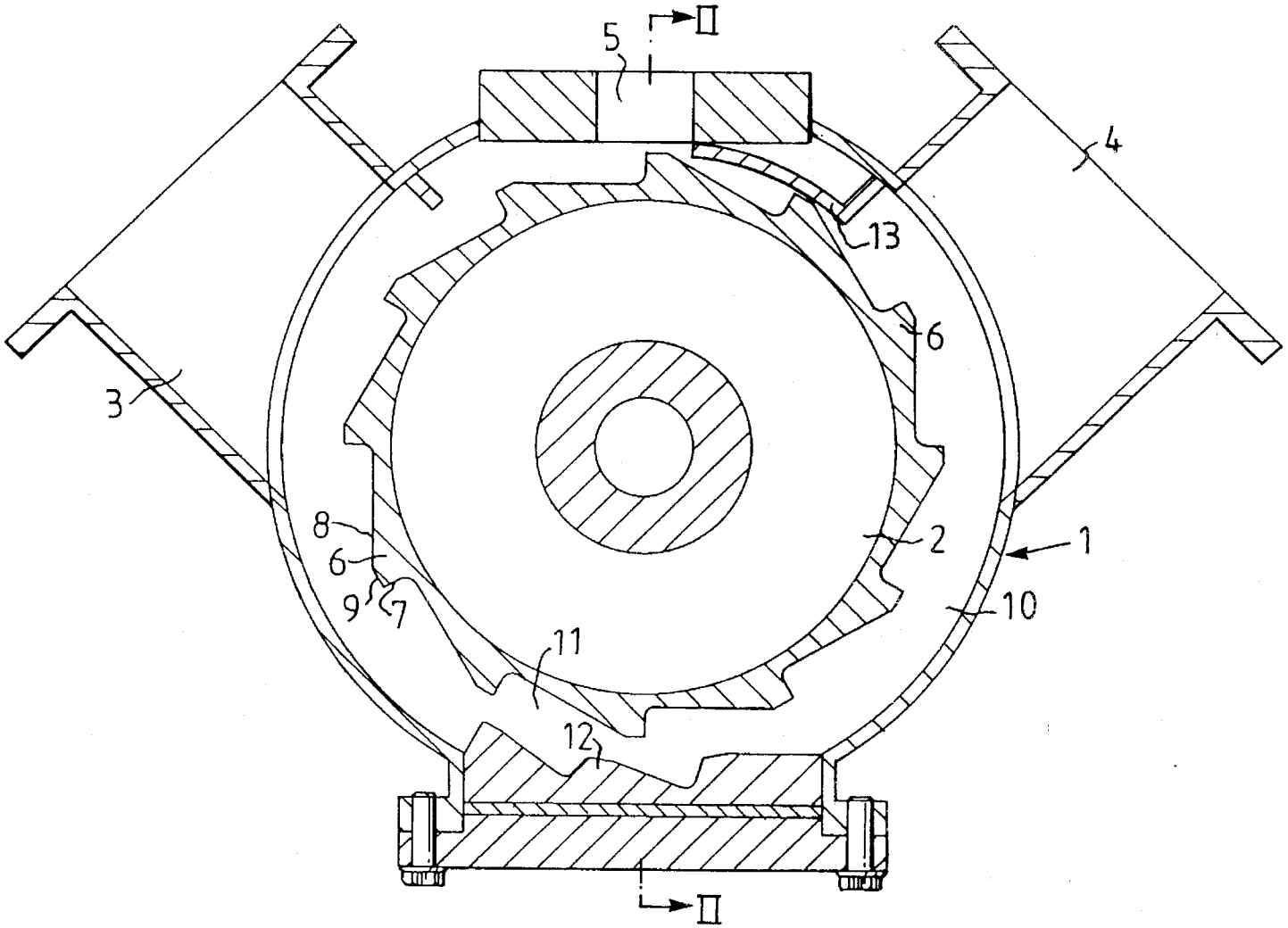
FIG. 1 is a side, elevational, cross-sectional view of a mixer according to the present invention.
Figure 2:
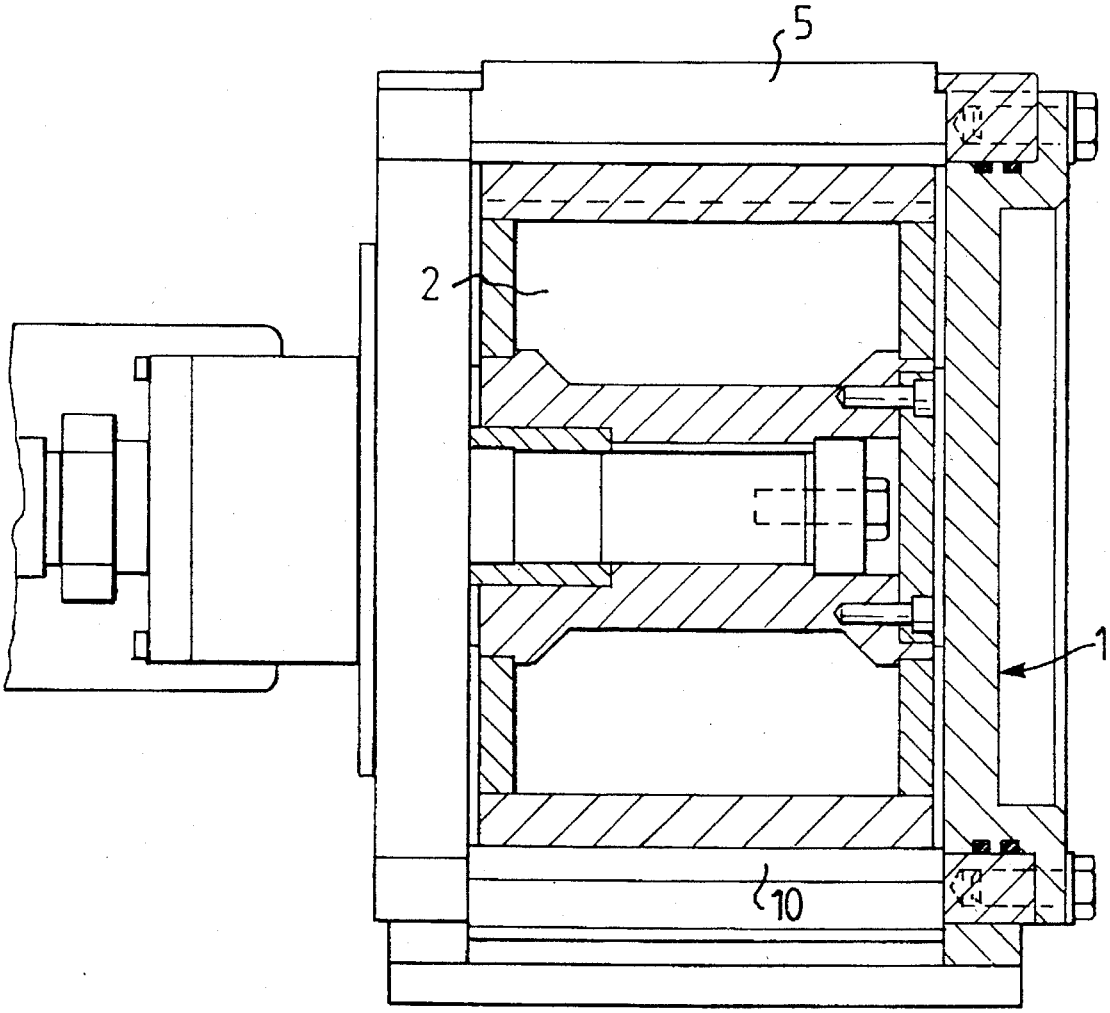
FIG. 2 is a side, partially cross-sectional view of the mixer shown in FIG. 1 taken along section II—II thereof.

Referring to the Figures, in which like numerals refer to like elements thereof, the mixer shown in FIG. 1 includes a housing 1, in which a rotor 2 is rotatably mounted. An inlet 3 for the pulp, an outlet 4 for the pulp, and an inlet 5 for the treatment agent, are each connected to the housing. The inlet 5 for the treatment agent can be located either before or after the supply of the pulp 3 (see FIGS. 1 and 3, respectively). The substantially cylindrical rotor 2 is provided with mixing members 6 on its casing surface, which members can extend substantially axially along the entire casing surface or a portion thereof. In the latter case, the members should be offset relative to each other in the circumferential direction. The members 6 preferably have a transverse, preferably right-angled leading edge 7 and a sloping trailing edge 8. Between the leading edge 7 and the trailing edge 8, the members 5 have a substantially planar portion 9. The clearance distance of members 6 from the root circle should be about 10 to 30 mm.

The housing 1 comprises a chamber 10 which is located radially outwardly from the rotor 3, and which is limited so that its width extends only along the axial length of the rotor. The chamber 10 can be limited outwardly by a cylindrical or edged surface, for example, a hexagonal surface. On a portion of the circumference, preferably within an angle of about 15° to 180°, the chamber 10 is formed with a mixing zone 11, the outer limiting surface of which is provided with stationary mixing members 12, which preferably have a trapezoidal cross-section, and which extend substantially axially either along the entire mixing zone, or along only a portion thereof. The radial distance between the mixing members 6 of the rotor and the stationary mixing members 12 is preferably between about 2 and 20 mm. The chamber 10 is provided directly in front of the mixing zone 11, between the inlet and the outlet of the pulp, with a cylindrical surface 13, which extends along a portion of the circumference, preferably within an angle of about 5° to 180°. The surface 13 should be located slightly spaced, preferably at a distance of from 1 to 4 mm, from the mixing members 6 of the rotor. This surface can be a portion of the outer wall of the chamber, or it can be formed as a separate detail attached to the chamber.

The pulp inlet 3 and pulp outlet 4 are connected to the chamber 10 of the housing 1 in the surface of the outer casing before and, respectively, after the mixing zone 11, as seen in the direction of rotation of the rotor 2. The inlet 3 and outlet 4 preferably extend along the entire width of the chamber.

Figure 3:
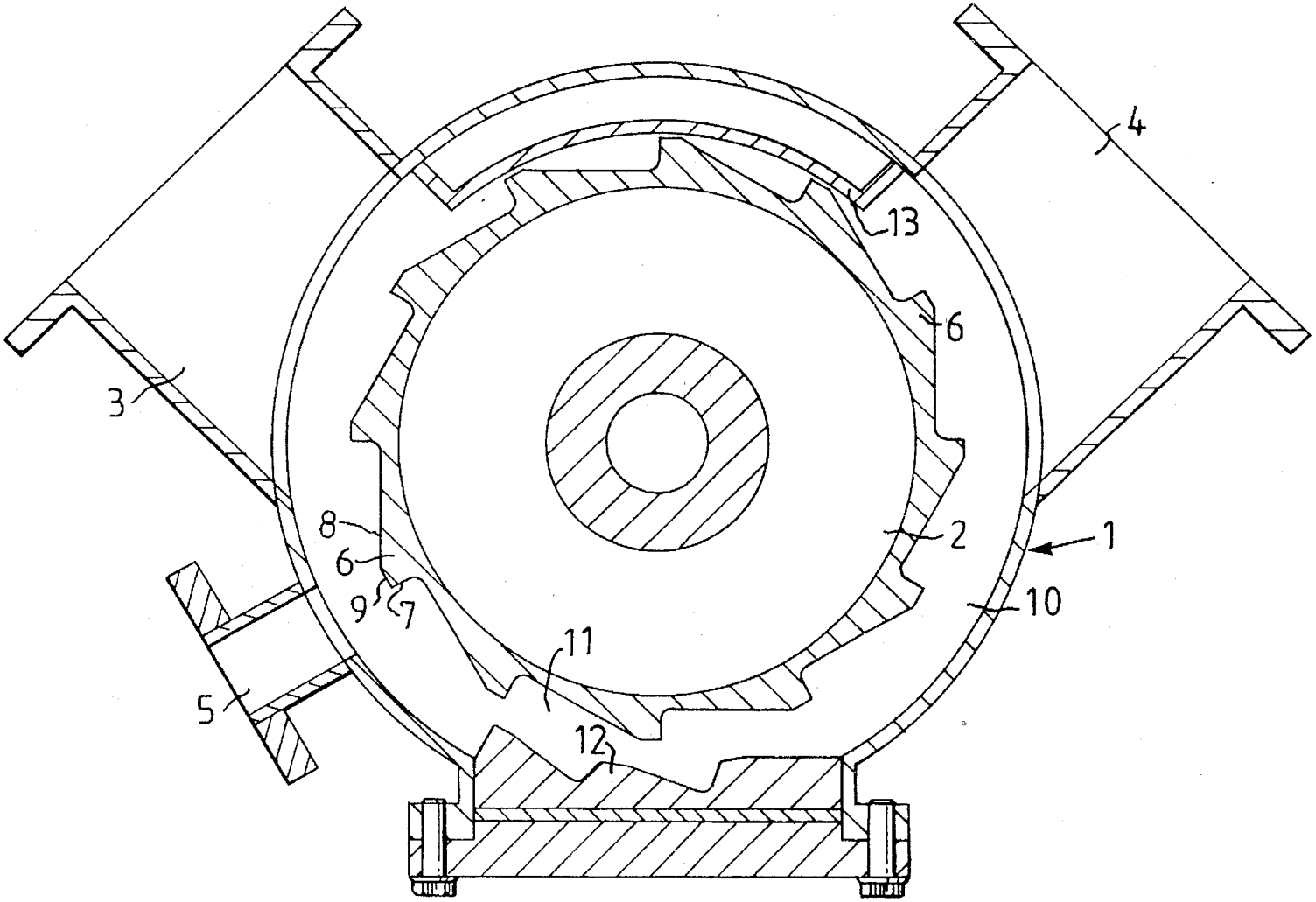
FIG. 3 is a front, elevational, cross-sectional view of another embodiment of the mixer according to the present invention.

The inlet 5 for treatment agent can be located in the manner shown in FIGS. 1 and 3, i.e., either before or after the pulp inlet 3. In either case, the inlet preferably extends along the width of the chamber 10. When the inlet 5 is located before the pulp inlet 3, it can be placed in or after the cylindrical surface 13. In certain cases, it may be suitable to place inlets for treatment agents both before and after the pulp inlet 3. According to this embodiment, for example, different treatment agents can be added each through its respective inlet 5.

In view of the design of the apparatus of the present invention, the treatment agent is admixed with high energy input to a small volume, in the form of a thin layer, so that substantially all of the energy is utilized for the admixing work. The pulp and treatment agent are each added in well-formed thin layers, through their respective inlets 3 and 5, respectively. Immediately thereafter the mixing is carried out in the mixing zone 11 by means of the mixing members 6 of the rotor 2 in cooperation with the stationary mixing members 12. In the mixing zone 11, the pulp is subjected to kneading, by which it is meant that fiber flocks in the pulp are repeatedly stretched and compressed between the mixing members.

The staying time of the pulp mixture within the mixing zone is very short (for example, from about 1/100 to 1/5 second), but due to the fact that the mixing takes place in a thin layer, as described above, efficient and uniform admixing is achieved. The energy input can be, for example, from about 0.5 to 5 kwh/ton pulp.

The object of the cylindrical surface 13 is to prevent pulp from flowing backward past the rotor. The small amounts of treated pulp returned in the gaps between the mixing members 6 of the rotor have no detrimental effect on the result of the mixing.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

We claim:

1. A method for mixing a treatment agent with a pulp suspension comprising supplying said pulp suspension to a mixing chamber defined by a housing having stationary mixing means along a portion thereof and a width, moving said pulp suspension through a mixing zone within said mixing chamber by rotating a cylindrical rotor having mixing members mounted thereon within said housing, said mixing zone having a height defined by the distance between said mixing members and said stationary mixing means, and supplying said treatment agent to said moving pulp suspension across said entire width of said mixing chamber prior to said mixing zone, said height of said mixing zone being such that said pulp suspension and said treatment agent are subjected to kneading within said mixing zone in order to repeatedly stretch and compress fiber flocks in said pulp suspension.

2. The method of claim 1 wherein said pulp suspension has a concentration of between about 10 and 25%.

3. The method of claim 1 wherein said kneading in said mixing zone is carried out at an energy input of between about 0.5 and 5 kwh per ton of said pulp suspension.

4. The method of claim 1 wherein said pulp suspension and said treatment agent pass through said mixing zone for a time period of about 1/100 to about 1/5 of a second.

5. Apparatus for mixing a treatment agent with a pulp suspension comprising a housing having an inner wall and a width, a substantially cylindrical rotor rotatably mounted within said housing for rotation in a first direction about an axis, said rotor having an axial length substantially corresponding to said width of said housing, and having an outer surface including mixing members thereon, a mixing chamber defined by the space between said housing and said rotor, an inlet in said housing for providing said pulp suspension to said mixing chamber, an outlet in said housing for withdrawing said mixed pulp suspension and treatment agent from said mixing chamber, stationary mixing means mounted on said inner wall of said housing for a distance therealong thereby defining a mixing zone between said stationary mixing means and said mixing members on said outer surface of said rotor, and a treatment agent inlet in said housing located before said mixing zone in said first direction of rotation of said rotor for providing said treatment agent to said mixing chamber.

6. The apparatus of claim 5 wherein said distance of said stationary mixing means comprises from about 15° to 180° of the circumference of said inner wall surface of said housing.

7. The apparatus of claim 5 wherein said mixing members comprise a plurality of mixing members extending substantially axially along said outer surface of said rotor.

8. The apparatus of claim 7 wherein said plurality of mixing members include a leading edge and a trailing edge in said first direction of rotation of said rotor, said leading edge being substantially transverse to said outer surface of said rotor, and said trailing edge forming a gradually sloping surface with respect to said outer surface of said rotor.

9. The apparatus of claim 5 wherein said stationary mixing means has a substantially trapezoidal cross-sectional shape.

10. The apparatus of claim 5 wherein the distance between said outer surface of said rotor and said stationary mixing means is between about 2 and 20 mm.

11. The apparatus of claim 5 including reverse flow prevention means mounted on said inner wall of said housing adjacent to said outlet in said first direction of rotation of said rotor to prevent the reverse flow of said pulp suspension towards said outlet in a direction opposite to said first direction of rotation of said rotor.

12. The apparatus of claim 11 wherein said reverse flow prevention means comprises a cylindrical surface.

13. The apparatus of claim 12 wherein said reverse flow prevention means extends along said inner surface of said housing for a distance corresponding to about 5° to 180° of the circumference of said mixing chamber.

14. The apparatus of claim 13 wherein said reverse flow prevention means is mounted with respect to said mixing members on the outer surface of said rotor at a distance of from about 1 to 4 mm therefrom.

15. The apparatus of claim 11 wherein said treatment agent inlet is located between said reverse flow prevention means and said inlet of said housing.

16. The apparatus of claim 5 wherein said treatment agent inlet is located between said inlet of said housing and said mixing zone.

17. Apparatus for mixing a treatment agent with a pulp suspension comprising a housing having an inner wall and a width, a substantially cylindrical rotor rotatably mounted within said housing for rotation in a first direction about an axis, said rotor having an axial length substantially corresponding to said width of said housing, and having an outer surface including mixing members thereon, a mixing chamber defined by the space between said housing and said rotor, an inlet in said housing for providing said pulp suspension to said mixing chamber, an outlet in said housing for withdrawing said mixed pulp suspension and treatment agent from said mixing chamber, a treatment agent inlet in said housing for providing said treatment agent to said mixing chamber, stationary mixing means mounted on said inner wall of said housing for a distance therealong thereby defining a mixing zone between said stationary mixing means and said mixing members on said outer surface of said rotor, and reverse flow prevention means mounted on said inner wall of said housing adjacent to said outlet to prevent the flow of said pulp suspension back towards said inlet of said housing.

18. The apparatus of claim 17 wherein said reverse flow prevention means comprises a cylindrical surface.

19. The apparatus of claim 18 wherein said reverse flow prevention means extends along said inner wall of said housing for a distance corresponding to about 5° to 180° of the circumference of said mixing chamber.

20. The apparatus of claim 19 wherein said reverse flow prevention means is mounted with respect to said mixing members on the outer surface of said rotor at a distance of from about 1 to 4 mm therefrom.

21. Apparatus for mixing a treatment agent with a pulp suspension comprising a housing having an inner wall and a width, a substantially cylindrical rotor rotatably mounted within said housing for rotation in a first direction about an axis, said rotor having an axial length substantially corresponding to said width of said housing, and having an outer surface including mixing members thereon, a mixing chamber defined by the space between said housing and said rotor, an inlet in said housing for providing said pulp suspension to said mixing chamber, an outlet in said housing for withdrawing said mixed pulp suspension and treatment agent from said mixing chamber, stationary mixing means mounted on said inner wall of said housing for a distance therealong thereby defining a mixing zone between said stationary mixing means and said mixing members on said outer surface of said rotor, and a treatment agent inlet in said housing located before said mixing zone in said first direction of rotation of said rotor and extending along said width of said mixing chamber for providing said treatment agent to said mixing chamber.

22. The apparatus of claim 21 wherein said distance of said stationary mixing means comprises from about 15° to 180° of the circumference of said inner wall surface of said housing.

23. The apparatus of claim 21 wherein said mixing members comprise a plurality of mixing members extending substantially axially along said outer surface of said rotor.

24. The apparatus of claim 23 wherein said plurality of mixing members include a leading edge and a trailing edge in said first direction of rotation of said rotor, said leading edge being substantially transverse to said outer surface of said rotor, and said trailing edge forming a gradually sloping surface with respect to said outer surface of said rotor.

25. The apparatus of claim 21 wherein said stationary mixing means has a substantially trapezoidal cross-sectional shape.

26. The apparatus of claim 21 wherein the distance between said outer surface of said rotor and said stationary mixing means is between about 2 and 20 mm.

* * * * *